US005973306A

United States Patent [19]

Lee

[11] Patent Number: 5,973,306

[45] Date of Patent: Oct. 26, 1999

[54] MICROWAVE OVEN WITH AN OUTER AND AN INNER HOUSING AND A WAVEGUIDE FOR DIRECTING MICROWAVE ENERGY WITH THE INNER HOUSING

[75] Inventor: Ho Kyoung Lee, Kyungki-Do, Rep. of Korea

[73] Assignee: LG Electronics Inc., Rep. of Korea

[21] Appl. No.: 08/893,843

[22] Filed: Jul. 11, 1997

[30] Foreign Application Priority Data

Jul. 11, 1996 [KR] Rep. of Korea ..... 96-27904

[51] Int. Cl.[6] ..... H05B 6/70

[52] U.S. Cl. ..... 219/746; 219/748; 219/756

[58] Field of Search ..... 219/746, 748, 219/750, 695, 697, 756, 690, 693; 333/239, 240

[56] References Cited

U.S. PATENT DOCUMENTS

| | | | |
|---|---|---|---|
| 3,209,113 | 9/1965 | Verstraten et al. | 219/746 |
| 3,492,454 | 1/1970 | Smith | 219/746 |
| 3,555,232 | 1/1971 | Bleackley | 219/746 |
| 4,035,598 | 7/1977 | Van Amsterdam | 219/690 |
| 4,246,462 | 1/1981 | Meisel | 219/697 |
| 4,259,561 | 3/1981 | Roussy et al. | 219/693 |
| 4,282,887 | 8/1981 | Sterzer | 219/690 |
| 4,329,557 | 5/1982 | Staats | 219/746 |

FOREIGN PATENT DOCUMENTS

| | | | |
|---|---|---|---|
| 1 081 987 | 5/1960 | Germany | 219/746 |

*Primary Examiner*—Philip H. Leung
*Attorney, Agent, or Firm*—Osrolenk, Faber, Gerb & Soffen, LLP

[57] ABSTRACT

A microwave oven waveguide structure which allows the use of low frequency microwaves which is sufficient for cooking, includes an indent portion in a waveguide which is mounted on one side of the inner housing and to which a microwave generated from the magnetron is transmitted, in a microwave oven having an inner housing for forming a cavity for accommodating food and a magnetron for generating a microwave.

2 Claims, 5 Drawing Sheets

| MEASUREMENT POINT | TRANSMISSION FREQUENCY | SWR |
|---|---|---|
| ▽1 | 0.9150 | 1.0288 |
| ▽2 | 0.7384 | 1.4752 |
| ▽3 | 1.0280 | 1.1209 |
| ▽4 | 0.8104 | 1.7203 |

MICROWAVE OVEN WITH AN OUTER AND AN INNER HOUSING AND A WAVEGUIDE FOR DIRECTING MICROWAVE ENERGY WITH THE INNER HOUSING

BACKGROUND OF THE INVENTION

1. Field of the Invention

The present invention relates to a microwave oven, and more particularly, to a microwave oven waveguide structure which allows the use of low frequency microwaves that are sufficient for cooking without increasing the size of the waveguide.

2. The Description of the Prior Art

FIG. 1 is a view showing an inner housing of a microwave oven having a conventional waveguide, and FIG. 2 is an enlarged perspective view of portion Y in FIG. 1.

The inner housing 10H forms a cavity 10 therein for receiving food and on one side of the inner housing 10H is mounted a waveguide 2 for introducing microwave energy generated by a magnetron (not illustrated) into the cavity 10. A hole 2*a* for inserting an antenna (not illustrated) of the magnetron on the waveguide 2 is formed on the surface of the waveguide 2 which is opposite the surface that is in contact with the inner housing 10H. A square hole (not illustrated) for sending a microwave to the cavity 10 is formed on the surface (a) of the waveguide 2 placed in contact with one side of the inner housing 10H.

The conventional waveguide 2 is formed as a highly conductive rectangular pipe with a central hole formed on the surface which is opposite the surface that is in contact with the inner housing 10H. The waveguide 2 acts as a high pass filter. The wavelength of the microwaves that pass through the waveguide 2 depend upon the length of the waveguide 2 itself. Wavelengths having a frequency that is greater than a certain frequency do not pass through the waveguide 2. The wavelength is a maximum wavelength of the waveguide 2 which is referred to as a cut-off wavelength, and such certain frequency is referred to as a cut-off frequency.

If a frequency to be used as a magnetron is determined with a magnetron, a minimum length (a) of the waveguide 2 is determined. Here, the relation for obtaining the length (a) of the waveguide 2 is as follows:

$$a \geqq \lambda/2 \quad (1)$$

wherein 'a' denotes a length of the waveguide, and $\lambda$ a wavelength of the used frequency.

As shown in the relation (1), when the wavelength of the used frequency $\lambda$ is substituted in the relation (1), the minimum length (a) of the waveguide to be used is determined. Thereby, the cross-sectional size of the waveguide according to the cut-off frequency can be determined.

For example, in a domestic microwave oven generally using a frequency of 2,450 MHz, the wavelength ($\lambda$) is 122.4 mm, the length (a) of the waveguide 2 is about 62 mm according to the relation (1). Therefore, it can be concluded that when the length of the waveguide 2 is at least 62 mm, the 2,450 MHz of the microwave generally used can be passed.

Moreover, the frequency used in a commercial microwave oven is generally 915 MHz which is relatively low in comparison with that of the domestic microwave oven and has a high infiltration degree of microwaves to food, and especially has a good thawing ability. Since the wavelength ($\lambda$) of the frequency is 328 mm, the length (a) of the waveguide 2 is about 164 mm. Therefore, it can be concluded that when the length of the waveguide 2 exceeds at least 164 mm, microwaves of 915 MHz generally used can be passed.

When the rectangular waveguide according to the conventional art is adopted, the domestic microwave having about 100 mm of the length of the waveguide cannot pass the low frequency of 915 MHz. Therefore, only the high frequency of 2,450 MHz must be used. Accordingly, if the domestic microwave oven adopts 915 MHz of the low frequency, the length of the waveguide 2 must be formed to be at least 164 mm, which causes the size of the waveguide, and the volume of the cavity to be increased so as to correspond to that of the waveguide.

SUMMARY OF THE INVENTION

Accordingly, it is an object of the present invention to provide a microwave oven waveguide structure which allows the use of low frequency microwaves that are sufficient for cooking without increasing the size of the waveguide.

To achieve the above object, there is provide a microwave oven waveguide structure in which is mounted an indent portion in a waveguide which is mounted on one side of the inner housing and to which a microwave generated from the magnetron is transmitted in a microwave oven having an inner housing for forming a cavity for accommodating food and a magnetron for generating a microwave.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A microwave oven waveguide structure according to the present invention will now be described in detail.

Figure 1:
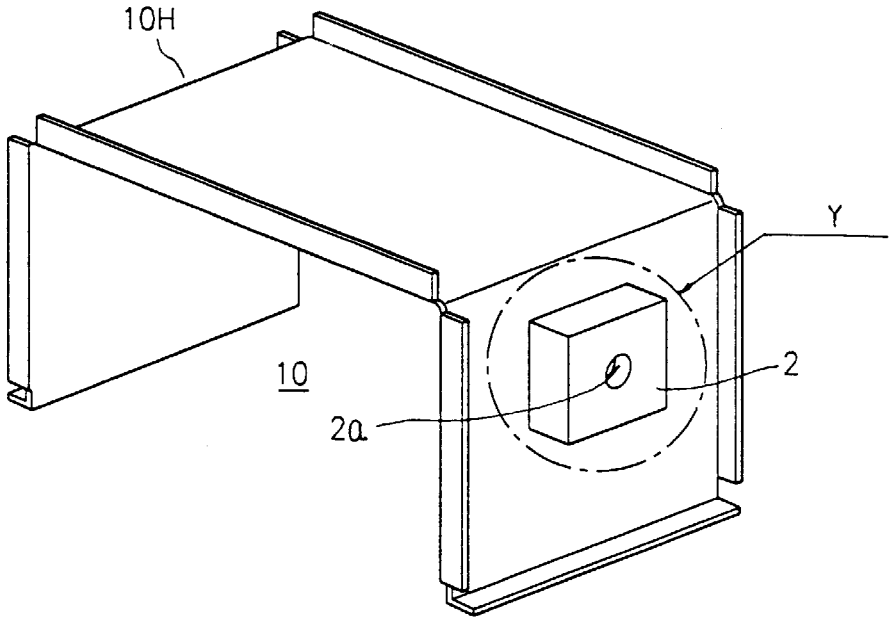
FIG. 1 CONVENTIONAL ART
FIG. 1 is a perspective view showing an inner housing of a microwave oven having a waveguide according to the conventional art.
Figure 2:
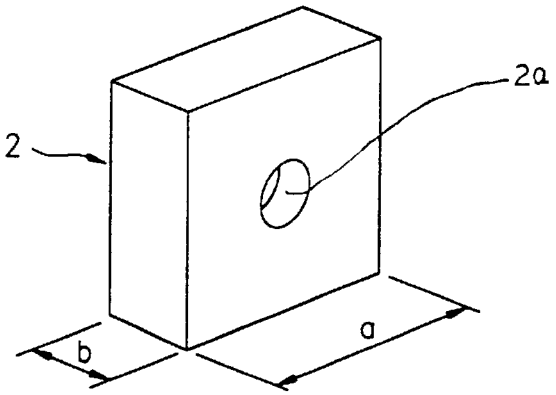
FIG. 2 CONVENTIONAL ART
FIG. 2 is an enlarged perspective view of portion Y in FIG. 1.
Figure 3:
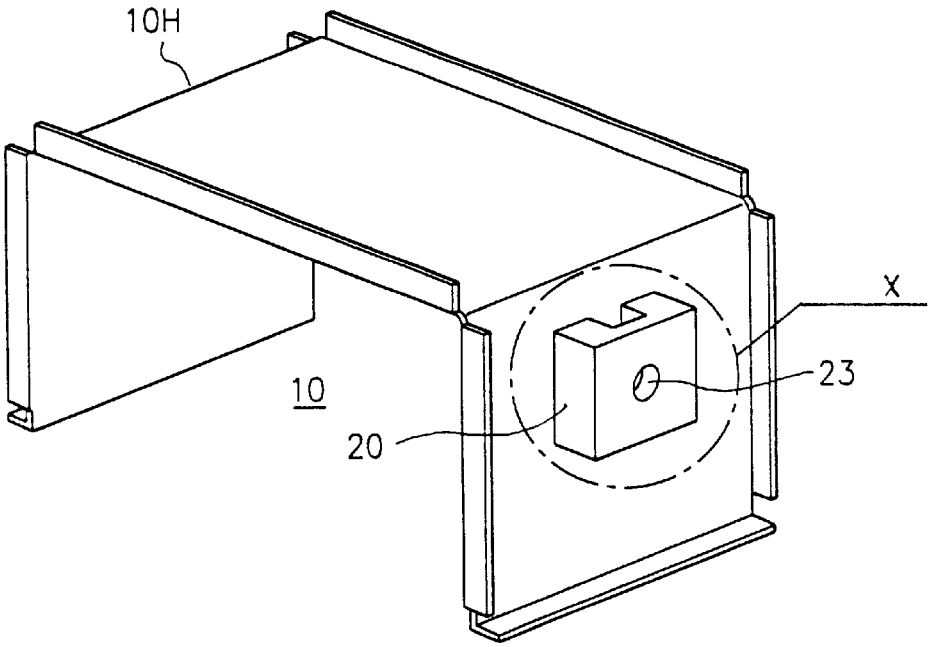
FIG. 3 is a perspective view showing an inner housing of a microwave oven having an indent-type waveguide according to the present invention.
Figure 4:
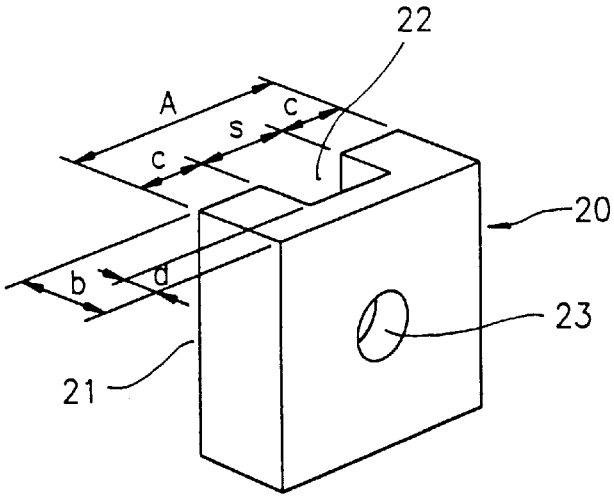
FIG. 4 is an enlarged perspective view of portion X in FIG. 3 showing an indent-type waveguide according to a first embodiment of the present invention.

FIG. 3 is a perspective view showing an inner housing of a microwave oven having an indent-type waveguide according to the present invention, and FIG. 4 is an enlarged perspective view of portion X in FIG. 3 showing an indent-type waveguide according to a first embodiment of the present invention.

As shown in these drawings, a waveguide 20 is installed on the side of an inner housing 10H, and the waveguide 20 has an indent portion formed on a surface which is attached to the side of the inner housing 10H. The indent portion 22 is formed along the direction in which a microwave generated by an antenna (not illustrated) of a magnetron inserted in the antenna insertion hole 23 is guided to a cavity 10. The indent portion is formed in the ⊂ shape when looking at the cross-sectional surface, and formed in the direction of the antenna insertion hole 23 protrudingly from the one side of the waveguide 20. Here, when the length of the waveguide 20 is 'A' and the width thereof is 'b', 'c' is formed to be of uniform length at both end of the waveguide 20 except 's' which is a length of the indent portion 22, and the total length of the two uniform lengths is a length of one side 21 of the waveguide 20 in contact with the side 10S of the inner housing 10H. 'd' is a portion which results from subtracting the height of the indent portion 22 from the width (b) of the waveguide 20.

The relation for obtaining a cut-off frequency in the waveguide 20 having the above structure is as follows:

$$\lambda c=2s+4bc/d \tag{2}$$

From the above relation, the cut-off wavelength (λc) can be obtained when the value of each element of the waveguide 20 with the indent portion 22 is substituted.

For example, if s is 40 mm, b 40 mm, c 40 mm and d 10 mm, according to the relation (2), the cut-off wavelength (λc) is 720 mm, and when this is calculated in terms of a cut-off frequency, the value is 416 MHz.

Accordingly, an infiltration degree of the microwave to food is high, and especially, 915 MHz of the low frequency having a good thawing ability can be passed. The waveguide 20 with the indent portion 22 has a length (A) of 120 mm, and therefore the size of the waveguide 20 can be reduced compared with the conventional waveguide 20 having a length of 164 mm when employing a frequency identical to that of the present invention.

Figure 5:
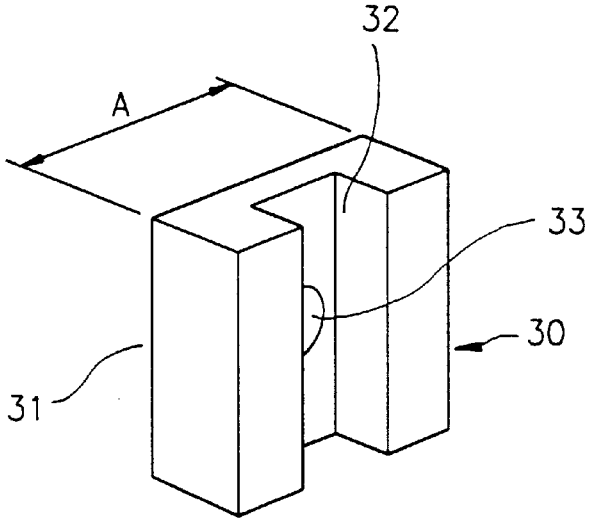
FIG. 5 is an enlarged perspective view of portion X in FIG. 3 showing an indent-type waveguide according to a second embodiment of the present invention.

FIG. 5 is an enlarged perspective view of portion X showing an indent-type waveguide according to a second embodiment of the present invention, and as shown in this drawing, in a waveguide 30, an indent portion 32 can be formed on the other side surface corresponding to one side surface in contact with one side surface of the inner housing 10H. That is, it can be formed on the surface on which an antenna insertion hole 33 is formed.

Figure 6:
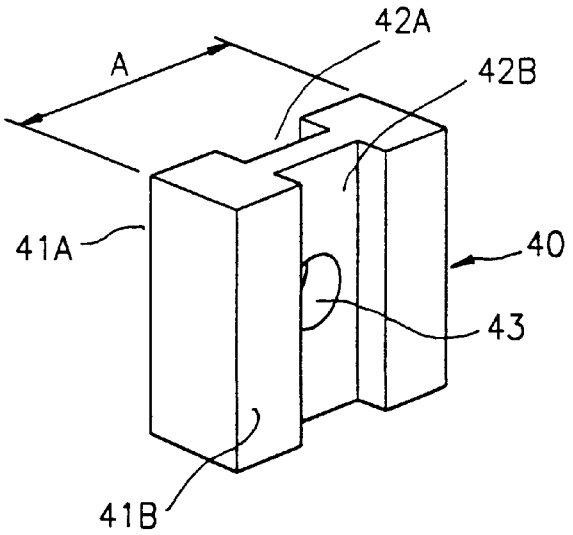
FIG. 6 is a perspective view showing an indent-type waveguide according to a third embodiment of the present invention.
Figure 7:
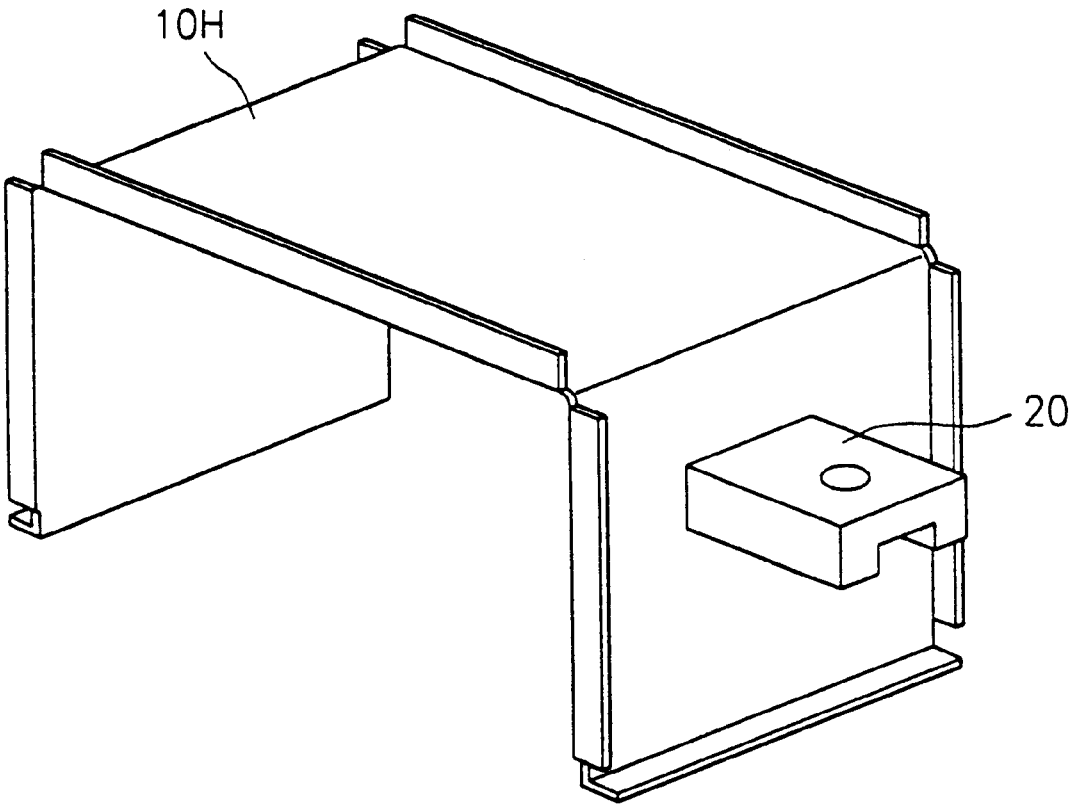
FIG. 7 is a perspective view showing an indent-type waveguide according to a fourth embodiment of the present invention.

FIG. 6 is an enlarged perspective view of portion X in FIG. 3 showing an indent-type waveguide according to a third embodiment of the present invention, and as shown in this drawing, a first indent portion 42A is formed on one side 41A of the waveguide 40 in contact with one side 10S of the inner housing 10H, and a second indent portion 42B is formed on the surface on which an antenna insertion hole 43 is formed.

As described above, since a waveguide with an indent portion according to the present invention can pass a low frequency only used in a commercial section, thereby the low frequency can be used without increasing the size of the waveguide.

Therefore, a low frequency can be passed through a smaller waveguide than that of the conventional art, thereby a compact size of a microwave oven can be achieved.

Figures 8A, 8B:
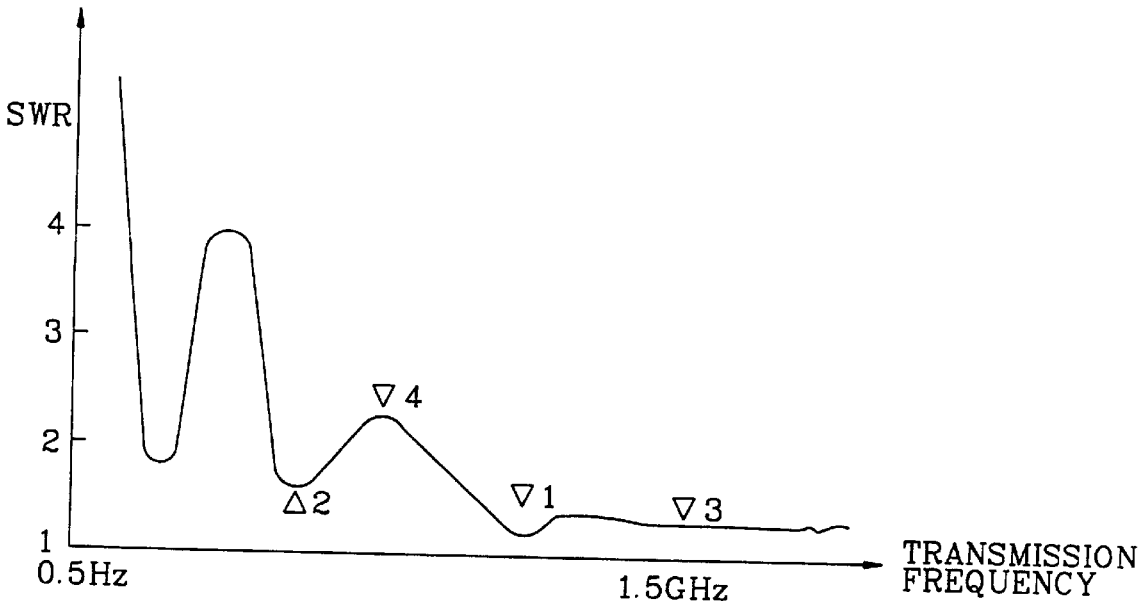
FIG. 8A is a graph showing the relation between transmission frequency and SWR or a waveguide.
FIG. 8B is a table showing values of transmission frequency and SWR of the waveguide at respective measurement points.

Referring to FIGS. 8A and 8B, the effects of the present invention will now be described. FIG. 8A is a graph illustrating a relation between transmission frequency and SWR (Standing Wave Ratio) of the waveguide, and FIG. 8B is a table illustrating respective values of the transmission frequency and the SWR of the waveguide at respective measurement points ▽1, ▽2, ▽3, ▽4 in FIG. 8A, wherein $$SWR = \frac{1+\Gamma}{1-\Gamma}$$

(where, Γ denotes reflection coefficient, and $0<\Gamma<<1$). As a result, the waveguide structure according to the present invention exhibits the best transmission capability at 0.915 GHz (915 MHz)

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. In a microwave oven including an inner housing having a cavity for holding food therein, a magnetron generating microwave energy, and a waveguide for guiding the microwave energy generated from the magnetron into the inner housing, the improvement wherein the waveguide comprises:

a main body portion having a first side, a second side and an aperature extending from the first side through the main body portion to the second side;

a first leg portion protruding from the second side of the main body portion; and a second leg portion protruding from the second side of the main body portion, wherein the first and second leg portions form an indent therebetween, and wherein said main body portion has a depth(d), said main body portion in connection with the first leg portion has a depth(b), said indent has a width(s), said each of the first and second leg portion has a width(c), and a cut-off frequency λc of said waveguide is defined by the equation:

$$\lambda c=2s+4bc/d.$$

2. The microwave oven of claim 1, wherein the frequency of microwave energy passing through the waveguide is about 915 MHz.

* * * * *